US006874825B1

(12) United States Patent
Rauner

(10) Patent No.: US 6,874,825 B1
(45) Date of Patent: Apr. 5, 2005

(54) DRAWER LOCKING ASSEMBLY

(76) Inventor: Paula M. Rauner, 5225 E. Thomas Road #209, Phoenix, AZ (US) 85018

( * ) Notice: Subject to any disclaimer, the term of this patent is extended or adjusted under 35 U.S.C. 154(b) by 0 days.

(21) Appl. No.: 10/794,818

(22) Filed: Mar. 8, 2004

(51) Int. Cl.[7] ..... E05C 5/02; E05B 65/44

(52) U.S. Cl. ..... 292/61; 292/175; 292/202; 292/290; 292/304; 70/85; 312/333

(58) Field of Search ..... 292/24, 342, 57–58, 292/60–62, 82, 175, 178, 181, 202–204, 210, 219, 220, 227, 229, 292, 289–290, 296–298, 303–304; 70/85–88; 403/83–84, 91–97, 103–104, 321, 322.1, 325–327; 312/215–216, 222, 333

(56) References Cited

U.S. PATENT DOCUMENTS

| | | | | | |
|---|---|---|---|---|---|
| 298,964 | A | * | 5/1884 | Franke et al. | 292/297 |
| 1,327,011 | A | * | 1/1920 | Arndt | 292/212 |
| 1,396,205 | A | * | 11/1921 | Hill et al. | 292/60 |
| 1,743,434 | A | * | 1/1930 | Cramer | 292/202 |
| 2,961,263 | A | * | 11/1960 | Ahlgren | 292/140 |
| 3,024,056 | A | * | 3/1962 | Cook | 292/177 |
| 3,437,365 | A | * | 4/1969 | Zadanoff et al. | 292/202 |
| 3,834,746 | A | | 9/1974 | Harden | |
| 4,530,528 | A | * | 7/1985 | Shamie | 292/60 |
| 4,632,438 | A | | 12/1986 | McKinney | |
| 4,635,976 | A | * | 1/1987 | Sigler | 292/67 |
| 5,147,099 | A | | 9/1992 | McLinden et al. | |
| 5,280,974 | A | | 1/1994 | Weintroub | |
| 5,445,451 | A | * | 8/1995 | Harmony | 312/333 |
| 5,505,505 | A | * | 4/1996 | Follows | 292/58 |
| 5,590,918 | A | * | 1/1997 | Kambalov | 292/60 |
| 5,647,618 | A | | 7/1997 | Lamberth | |
| 5,671,957 | A | | 9/1997 | Raffini | |
| 6,224,118 | B1 | * | 5/2001 | Ashford | 292/62 |
| 6,513,890 | B1 | * | 2/2003 | Tolnes et al. | 312/333 |
| 6,568,226 | B1 | * | 5/2003 | Ramsauer | 292/67 |
| 6,802,962 | B1 | * | 10/2004 | Browne, III et al. | 292/62 |

* cited by examiner

*Primary Examiner*—Daniel P. Stodola
*Assistant Examiner*—Christopher Boswell

(57) ABSTRACT

A drawer locking assembly includes a panel has a first side and a second side. The first side has a pressure sensitive adhesive thereon for selectively attaching the first side to a vertical surface adjacent to a drawer. A post is attached to the second side of the panel. The post has a terminal end. A peripheral lip is attached to and extends along a length of the terminal end. A plate has an inner surface and an outer surface. A sleeve is attached to and extends away from the inner surface. The sleeve has a free end having a well extending therein. An inwardly extending peripheral flange is attached to the free end. The terminal end of the post is positioned within the sleeve. The plate is selectively positionable over the drawer. A biasing member is positioned within the well and biases the lip away from the flange.

5 Claims, 2 Drawing Sheets

DRAWER LOCKING ASSEMBLY

BACKGROUND OF THE INVENTION

1. Field of the Invention

The present invention relates to drawer locking devices and more particularly pertains to a new drawer locking device for preventing the unwanted entry into a drawer by a toddler.

2. Description of the Prior Art

The use of drawer locking devices is known in the prior art. U.S. Pat. No. 5,647,618 describes a device that is attached to an inner surface of a cabinet for selectively locking the cabinet. Another type of drawer locking device is U.S. Pat. No. 5,280,974 having a latch that requires multiple actions for opening the latch.

While these devices fulfill their respective, particular objectives and requirements, the need remains for a device that is readily retrofitted to existing cabinets without complicated fastening devices and allows a person to lock a drawer in such a manner that prevents its opening by toddlers and young children.

SUMMARY OF THE INVENTION

The present invention meets the needs presented above by generally comprising a panel has a first side and a second side. The first side has a pressure sensitive adhesive thereon for selectively attaching the first side to a vertical surface adjacent to a drawer. A post is attached to and extends away from the second side of the panel. The post has a terminal end. A peripheral lip is attached to and extends along a length of the terminal end. A plate has an inner surface and an outer surface. A sleeve is attached to and extends away from the inner surface. The sleeve has a free end having a well extending therein. An inwardly extending peripheral flange is attached to the free end. The terminal end of the post is positioned within the sleeve. The plate is selectively positionable over the drawer. A biasing member is positioned within the well and biases the lip away from the flange.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
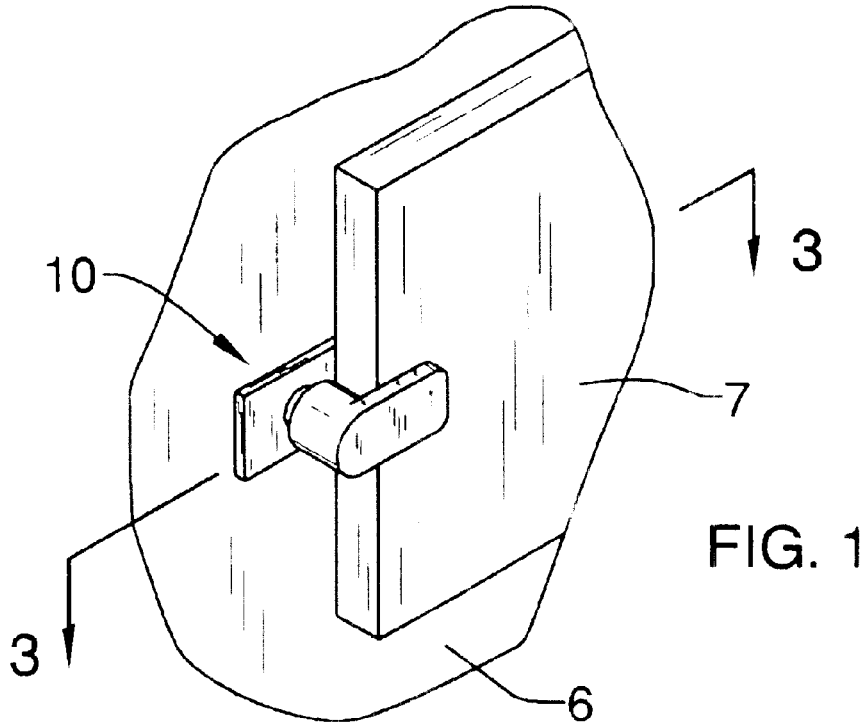
FIG. 1 is a schematic perspective in-use view of a drawer locking assembly according to the present invention.
Figure 2:
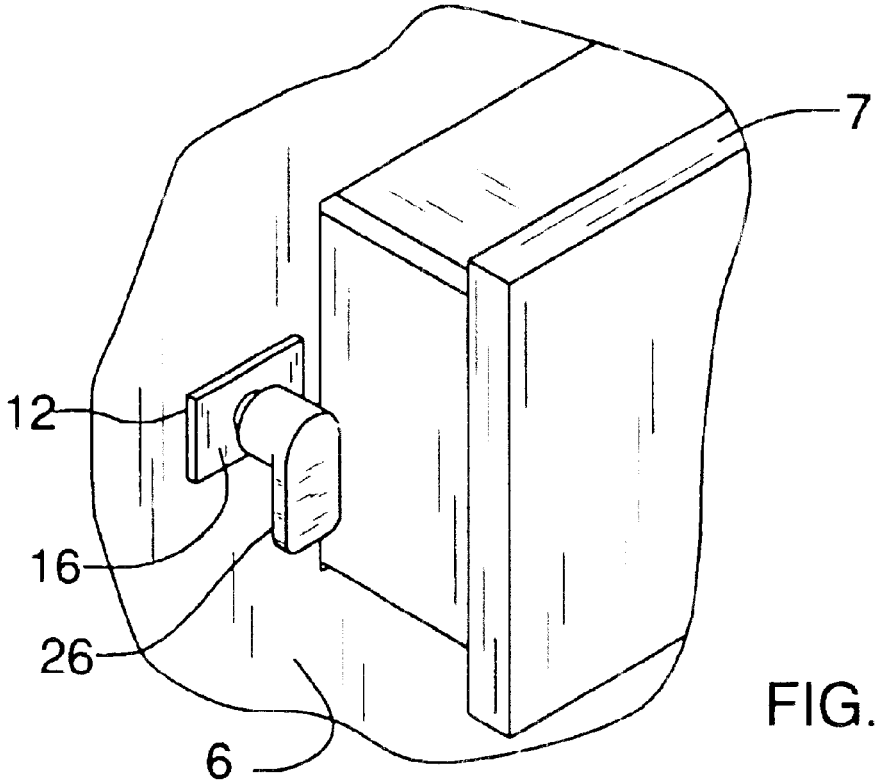
FIG. 2 is a schematic perspective in-use view of the present invention.
Figure 3:
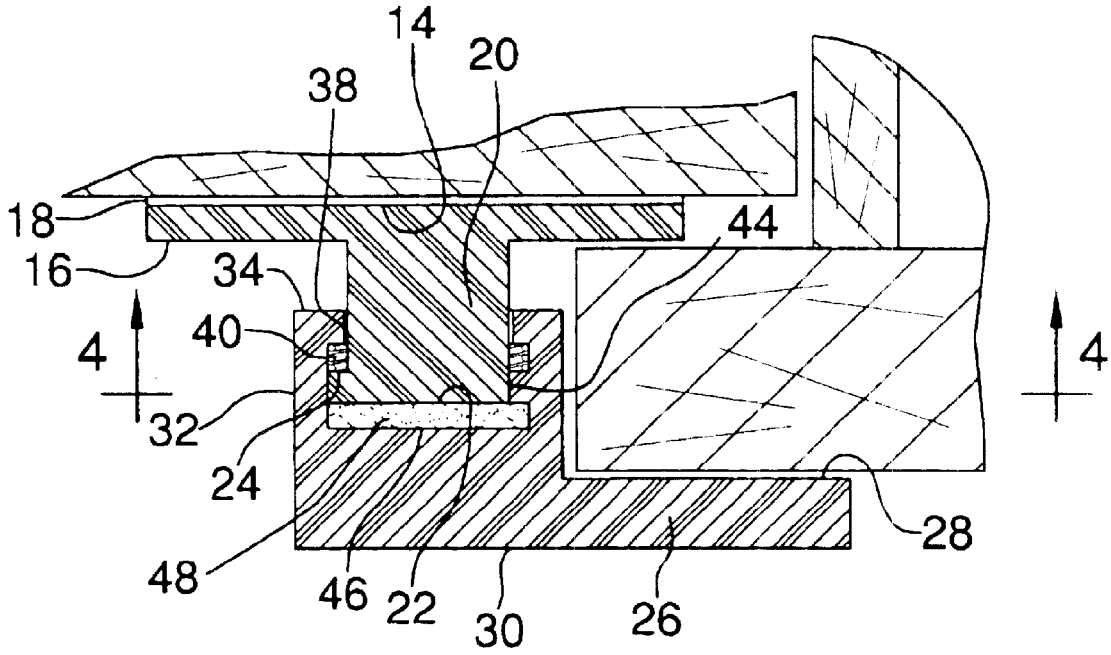
FIG. 3 is a schematic cross-sectional view taken along line 3—3 of FIG. 1 of the present invention.
Figure 4:
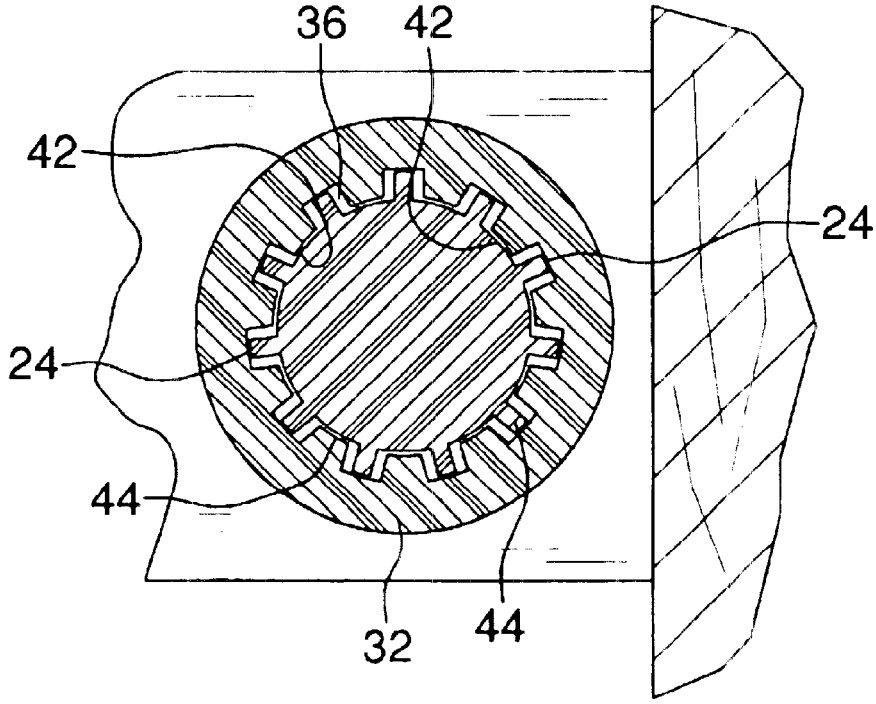
FIG. 4 is a schematic cross-sectional view taken along line 4—4 of 3 of the present invention.

With reference now to the drawings, and in particular to FIGS. 1 through 4 thereof, a new drawer locking device embodying the principles and concepts of the present invention and generally designated by the reference numeral 10 will be described.

As best illustrated in FIGS. 1 through 4, the drawer locking assembly 10 generally comprises a panel 12 having a first side 14 and a second side 16. The first side 14 has a pressure sensitive adhesive 18 thereon for selectively attaching the first side 14 to a vertical surface 6 adjacent to a drawer 7. A post 20 is attached to and extends away from the second side 16 of the panel 12. The post 20 has a terminal end 22 and a peripheral lip 24 is attached to and extends along a length of the terminal end 22.

A plate 26 has an inner surface 28 and an outer surface 30. A sleeve 32 is attached to and extends away from the inner surface 28. The sleeve 32 has a free end 34 having a well 36 extending therein. An inwardly extending peripheral flange 38 is attached to the free end 34. The terminal end 22 of the post 20 is positioned within the sleeve 32. The plate 26 is selectively positionable over the drawer 7. A biasing member 40 is positioned within the well 36 and biases the lip 24 away from the flange 38. The biasing member 40 is preferably a compression spring.

A locking assembly is adapted for selectively allowing rotation of the post 20 with respect to the sleeve 32. The locking assembly includes a plurality of notches 42 extending into the peripheral lip 24. A plurality of teeth 44 is attached to an inner surface of the well 36. The teeth 44 are positioned generally between the flange 38 and a bottom wall 46 of the well 36. The teeth 44 are positioned for engaging the notches 42 when the terminal end 22 is positioned between the flange 38 and the bottom wall 46. A resiliently compressible member 48 is attached to the bottom wall 46. The resiliently compressible member 48 is preferably comprised of a foamed rubber or other elastomeric material. The teeth 44 engage the notches 42 when the terminal end 22 is abutting the compressible member 48 to prevent rotation of the sleeve 32. Alternate locking mechanisms that require pressure on the plate 26 in order to turn the plate 36 may also be used. These include, but are not limited to, conventional child safety caps used on medicine bottles and the like.

In use, the panel 12 is attached to the vertical surface 6 adjacent to a drawer 7 so that the plate 26 may be moved over an edge of the drawer 7 as depicted in FIG. 1. In this position, the drawer 7 is locked in a closed position. The biasing member 40 keeps the teeth 44 in the notches 42 so that the plate 26 may not be rotated. In order to rotate the plate 26 away from the drawer 7, the plate 26 is pressed inward so that the teeth 44 are disengaged with the notches 42 and the sleeve 32 is allowed to rotate. A rigid cover may be positioned between the compressible material 48 and the terminal end 22 to aid in the rotation of the sleeve 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lock assembly for a drawer, said assembly being removably attached to a vertical surface adjacent to a drawer, said assembly including:

a panel having a first side and a second side, said first side having a pressure sensitive adhesive thereon for selectively attaching said first side to the vertical surface;

a post being attached to and extending away from said second side of said panel, said post having a terminal end, a peripheral lip being attached to and extending along a length of said terminal end;

a plate having an inner surface and an outer surface, a sleeve being attached to and extending away from said inner surface, said sleeve having a free end having a well extending therein, an inwardly extending peripheral flange being attached to said free end, said terminal end of said post being positioned within said sleeve, said plate being selectively positionable over the drawer; and a biasing member being positioned within said well and biasing said lip away from said flange.

2. The assembly according to claim 1, further including a locking assembly being adapted for selectively allowing rotation of said post with respect to said sleeve.

3. The assembly according to claim 2, wherein said locking assembly includes a plurality of notches extending into said peripheral lip, a plurality of teeth being attached to an inner surface of said well, said teeth being positioned generally between said flange and a bottom wall of said well, said teeth being positioned for engaging said notches when said terminal end is positioned between said flange and said bottom wall.

4. The assembly according to claim 3, wherein said locking assembly further includes a resiliently compressible member being attached to said bottom wall, wherein said teeth engage said notches when said terminal end is abutting said compressible member.

5. A lock assembly for a drawer, said assembly being removably attached to a vertical surface adjacent to a drawer, said assembly including:

a panel having a first side and a second side, said first side having a pressure sensitive adhesive thereon for selectively attaching said first side to the vertical surface;

a post being attached to and extending away from said second side of said panel, said post having a terminal end, a peripheral lip being attached to and extending along a length of said terminal end;

a plate having an inner surface and an outer surface, a sleeve being attached to and extending away from said inner surface, said sleeve having a free end having a well extending therein, an inwardly extending peripheral flange being attached to said free end, said terminal end of said post being positioned within said sleeve, said plate being selectively positionable over the drawer;

a biasing member being positioned within said well and biasing said lip away from said flange;

a locking assembly being adapted for selectively allowing rotation of said post with respect to said sleeve, said locking assembly including;

a plurality of notches extending into said peripheral lip;

a plurality of teeth being attached to an inner surface of said well, said teeth being positioned generally between said flange and a bottom wall of said well, said teeth being positioned for engaging said notches when said terminal end is positioned between said flange and said bottom wall; and a resiliently compressible member being attached to said bottom wall, wherein said teeth engage said notches when said terminal end is abutting said compressible member.

* * * * *